US009115531B1

(12) United States Patent
Chen

(10) Patent No.: US 9,115,531 B1
(45) Date of Patent: Aug. 25, 2015

(54) COVERING OF BUILDING'S OPENING

(71) Applicant: NIEN MADE ENTERPRISE CO., LTD., Taichung (TW)

(72) Inventor: Lin Chen, Taichung (TW)

(73) Assignee: NIEN MADE ENTERPRISE CO., LTD., Taichung (TW)

( * ) Notice: Subject to any disclaimer, the term of this patent is extended or adjusted under 35 U.S.C. 154(b) by 0 days.

(21) Appl. No.: 14/262,956

(22) Filed: Apr. 28, 2014

(51) Int. Cl.

| | |
|---|---|
| ***E05D 15/26*** | (2006.01) |
| ***E06B 5/00*** | (2006.01) |
| ***E06B 3/26*** | (2006.01) |
| ***E06B 3/30*** | (2006.01) |
| ***E06B 9/06*** | (2006.01) |
| ***E06B 3/48*** | (2006.01) |

(52) U.S. Cl.
CPC ..... *E06B 5/003* (2013.01); *E06B 3/2605* (2013.01); *E06B 3/30* (2013.01); *E06B 3/48* (2013.01); *E06B 9/06* (2013.01)

(58) Field of Classification Search
CPC ..... E06B 3/48; E06B 9/06; E06B 5/003; E06B 3/2605; E06B 3/30
USPC ..... 160/87, 88, 89, 90, 91, 114, 113, 183, 160/199, 206
See application file for complete search history.

(56) References Cited

U.S. PATENT DOCUMENTS

| | | | | | |
|---|---|---|---|---|---|
| 1,426,170 | A | * | 8/1922 | Frantz | 49/260 |
| 1,463,346 | A | * | 7/1923 | Walker | 160/118 |
| 1,503,364 | A | * | 7/1924 | Howat | 160/199 |
| 1,570,958 | A | | 1/1926 | Frantz | |
| 2,572,153 | A | * | 10/1951 | Horn | 160/206 |
| 2,860,701 | A | * | 11/1958 | Carter et al. | 160/199 |
| 3,022,818 | A | * | 2/1962 | Rolfe | 160/206 |
| 3,029,868 | A | * | 4/1962 | Ogburn et al. | 160/118 |
| 3,101,777 | A | * | 8/1963 | Sherron | 160/206 |
| 3,102,582 | A | * | 9/1963 | Rudnick | 160/206 |
| 3,138,474 | A | * | 6/1964 | Reiss et al. | 160/206 |
| 3,275,064 | A | * | 9/1966 | Hansen | 160/206 |
| 3,295,257 | A | * | 1/1967 | Douglass | 49/317 |
| 3,342,246 | A | * | 9/1967 | Reiss | 160/195 |
| 3,554,267 | A | * | 1/1971 | Brinker | 160/118 |
| 3,597,790 | A | * | 8/1971 | Kellems et al. | 16/244 |
| 3,614,975 | A | * | 10/1971 | Aymond | 60/206 |
| 3,866,658 | A | * | 2/1975 | Smith | 160/206 |
| 3,938,577 | A | * | 2/1976 | Richards | 160/90 |
| 3,946,790 | A | * | 3/1976 | Besse | 160/206 |
| 3,987,837 | A | * | 10/1976 | Hewson | 160/206 |
| 4,044,812 | A | * | 8/1977 | Swanstrom | 160/206 |
| 4,109,346 | A | * | 8/1978 | Strozier | 16/235 |
| 4,386,646 | A | * | 6/1983 | Matyas | 160/206 |
| 4,432,406 | A | * | 2/1984 | Belanger et al. | 160/199 |
| 4,848,436 | A | * | 7/1989 | Dagenais | 160/199 |
| 4,957,600 | A | * | 9/1990 | Carlson et al. | 160/199 |

(Continued)

*Primary Examiner* — Katherine Mitchell
*Assistant Examiner* — Johnnie A Shablack
(74) *Attorney, Agent, or Firm* — Ming Chow; Sinorica, LLC

(57) ABSTRACT

A covering of a building opening includes a rail, a first sash, and a second sash. The rail has a first end and a second end at opposite ends, wherein the rail is straight from the first end to the second end. The first sash is connected to a first axle, wherein the first axle is adjacent to the first end of the rail. The second sash is hinged with the first sash, and connected to a second axle, wherein the second axle is engaged with the rail to reciprocate along the rail. The first axle is not on a moving path of the second axle, nor an extending line of the moving path of the second axle. The covering further includes an adjustable assembly for adjusting a vertical position and a horizontal position of the first sash.

14 Claims, 11 Drawing Sheets

(56) References Cited

U.S. PATENT DOCUMENTS

| | | | | | |
|---|---|---|---|---|---|
| 5,054,163 | A * | 10/1991 | Sterling et al. | 16/244 |
| 5,085,261 | A * | 2/1992 | Bortoluzzi | 160/199 |
| 5,392,834 | A * | 2/1995 | Borgardt | 160/118 |
| 5,548,869 | A * | 8/1996 | Ryczek | 16/93 R |
| 5,920,956 | A * | 7/1999 | Salice | 16/87 R |
| 6,213,187 | B1 * | 4/2001 | Hughes | 160/90 |
| D502,387 | S * | 3/2005 | Hyakkoku | D8/354 |
| 6,925,685 | B2 * | 8/2005 | Chen | 16/332 |
| 7,258,153 | B2 * | 8/2007 | Chen | 160/206 |
| 7,762,305 | B2 * | 7/2010 | Huang | 160/201 |
| 8,096,341 | B2 * | 1/2012 | Teunissen | 160/199 |
| 8,671,633 | B2 * | 3/2014 | Haab et al. | 52/243.1 |
| 2005/0241781 | A1 * | 11/2005 | Johnson | 160/199 |
| 2006/0231218 | A1 * | 10/2006 | Liang | 160/206 |
| 2009/0178770 | A1 * | 7/2009 | Teunissen | 160/165 |
| 2014/0299280 | A1 * | 10/2014 | Bowman et al. | 160/199 |

* cited by examiner

COVERING OF BUILDING'S OPENING

BACKGROUND OF THE INVENTION

1. Field of the Invention

The present invention relates generally to a door or window, and more particularly to a covering of a building's opening.

2. Description of the Related Art

A covering for an opening of a building, such as window or door, has various types. Take a window for example, the common type of the window has two sliding or hinged sashes. In this type of window, the sashes take some space of the window opening. It is bad for ventilation. Another window is similar to a casement window, having two hinged sashes, one of which is pivoted on the frame, and the other one of which is slidably engaged with a rail. Slide the sash will fold the sashes. In this window covering, the rail is straight, and the sash can't be moved when the folded sashes fold up. Therefore, people may hit the sashes when he/she walks by U.S. Pat. No. 1,570,958 disclosed a conventional door having a warp rail 1 as shown in FIG. 1. The rail 1 includes a straight section 1*a* and a curved section 1*b*. A first sash 2 is pivoted on a wall W, and a second sash 3 is hinged with the first sash 2. The second sash 3 is provided with a pulley assembly 4 to engage the rail 1. Just like the casement window, the second sash 3 is moved toward the first sash 2 to open the door. The sashes 2, 3 are folded, and moved off the opening because of the curved section 1*b*. It is easy to understand that the warp rail is expensive and difficult to manufacture. Furthermore, the warp rail makes the sashes move in a strange way. It is not good looking. In addition, while the sashes 2, 3 are opened, although they still are attached to the wall W (shown as the dot lines in the drawing), they are not tightly folded together.

SUMMARY OF THE INVENTION

The primary objective of the present invention is to provide a covering of a building's opening, which provides the sashes to be folded and attached to the wall with a straight rail when one opens the covering.

According to the objective of the present invention, a covering of a building opening includes a rail, a first sash, and a second sash. The rail has a first end and a second end at opposite ends, wherein the rail is straight from the first end to the second end. The first sash is connected to a first axle, wherein the first axle is adjacent to the first end of the rail. The second sash is hinged with the first sash, and connected to a second axle, wherein the second axle is engaged with the rail to reciprocate along the rail. The first axle is not on a moving path of the second axle, nor an extending line of the moving path of the second axle.

In an embodiment, the rail has a front side at a front, a rear side at a rear, and a rail opening at a bottom; the first axle is by the rear side of the rail and near the first end; the second axle has opposite ends engaged with the rail via the rail opening and connected to the second sash respectively.

In an embodiment, the covering further includes a rail base and a pivoting base, wherein the rail is fixed to a bottom of the rail base, and the pivoting base is fixed to the rear of the first sash; the first axle is vertical which has an end connected to the rail base and an opposite end pivoted on the pivoting base.

In an embodiment, the rail base comprises a case, and the case has a front side and a rear side; the rail is received in the rail base between the front side and the rear side; a distance between the front side and the rear side of the rail base is greater than a distance between the front side and the rear side of the rail.

In an embodiment, the covering further includes a pulley assembly engaged with the rail to reciprocate along the rail, wherein the opposite ends of the second axle are connected to the pulley assembly and a top of the second sash respectively.

In an embodiment, the rail has a top side at a top, a bottom side at a bottom, and a rail opening at a front; the first axle is under the bottom side of the rail and near the first end; the second axle has opposite ends engaged with the rail via the rail opening and connected to the second sash respectively.

In an embodiment, the covering further includes a pulley base and a pulley connected to the pulley base for rotation, wherein the pulley is engaged with the rail, and the pulley base is left out of the rail; the opposite ends of the second axle are connected to the pulley base and the second sash respectively.

In an embodiment, the second axle is a U-shaped bar having the opposite ends connected to a top of the pulley base and a top of the second sash respectively.

In an embodiment, the covering further includes an adjustable assembly under the first sash for change a vertical position of the first sash.

In an embodiment, the adjustable assembly includes a lateral member, a base member, and a thread rod; the lateral member is fixed to the first sash and has a threaded axial bore; the thread rod has an end screwed into the axial bore of the lateral member and an opposite end connected to the base member, whereby the vertical position of the first sash is changed by turning the thread rod.

In an embodiment, the base member has a cavity and a hole at a bottom of the cavity, and the thread rod has a rim and a protrusion on the rim; the protrusion is received in the hole, and the rim is received in the cavity, whereby the threaded rod turns freely related to the base member.

In an embodiment, the covering further includes an adjustable assembly under the first sash for change a horizontal position of the first sash.

In an embodiment, the adjustable assembly includes a lateral member, a base member, a rod, and a movable plate; the lateral member is fixed to the first sash; the base member has an elongated slot, and the movable plate is engaged with the slot to move along the slot; the rod has opposite end connected to the movable plate and the lateral member, whereby the horizontal position of the first sash is by moving the movable plate.

In an embodiment, the adjustable assembly further includes a movable block received in the slot of the base member and a bolt; the movable block has a threaded hole, and the movable plate has a through hole; the bolt passes through the through hole of the movable plate, and is screwed into the threaded hole of the movable block to fix the movable plate to the base member by tightening the bolt.

Therefore, the hanger of the present invention may be incorporated in a straight rail, and make the sashes totally move off the window opening.

DETAILED DESCRIPTION OF THE INVENTION

Figure 1:
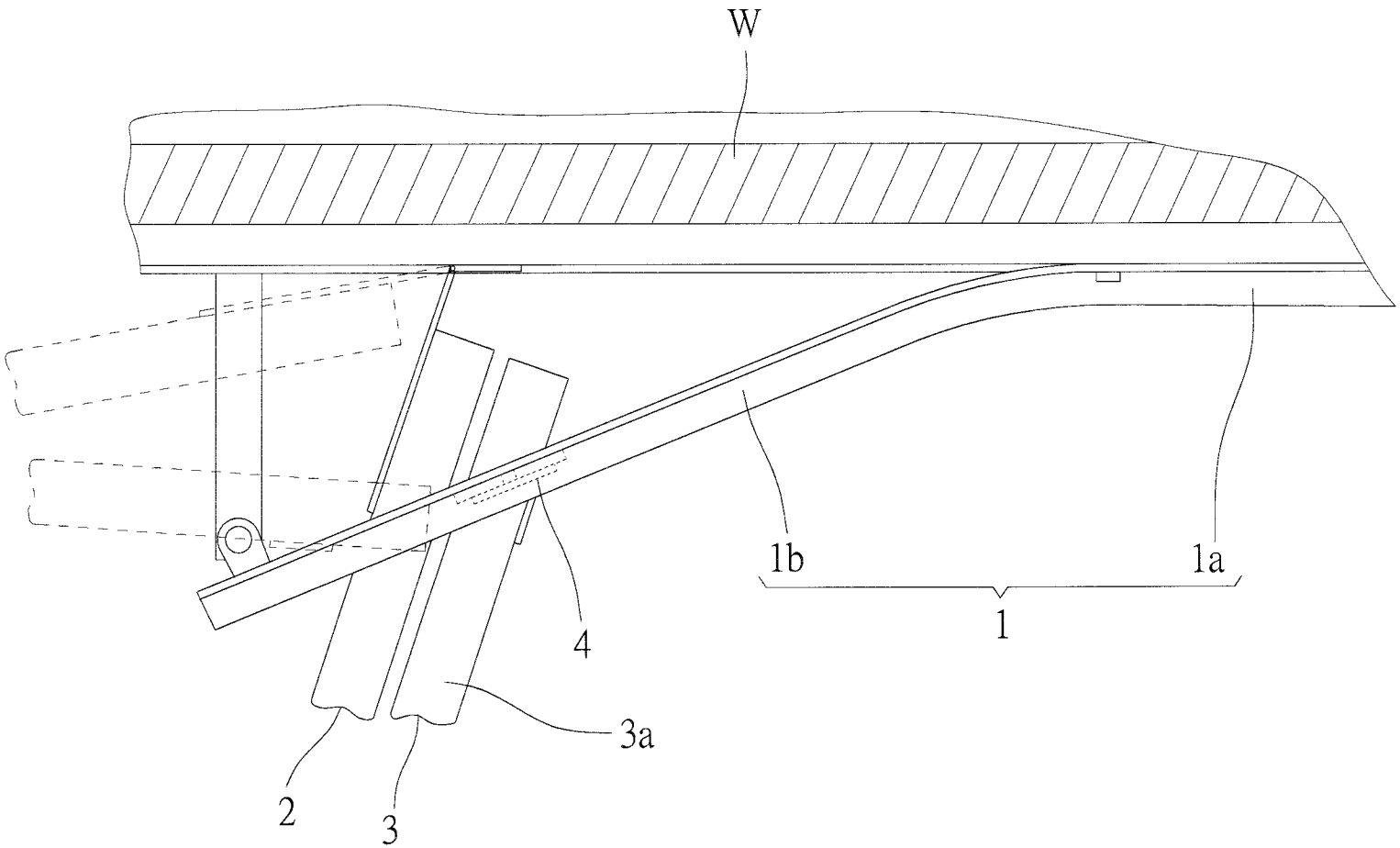
FIG. 1 (PRIOR ART)
FIG. 1 is a sketch diagram of the conventional door.
Figure 2:
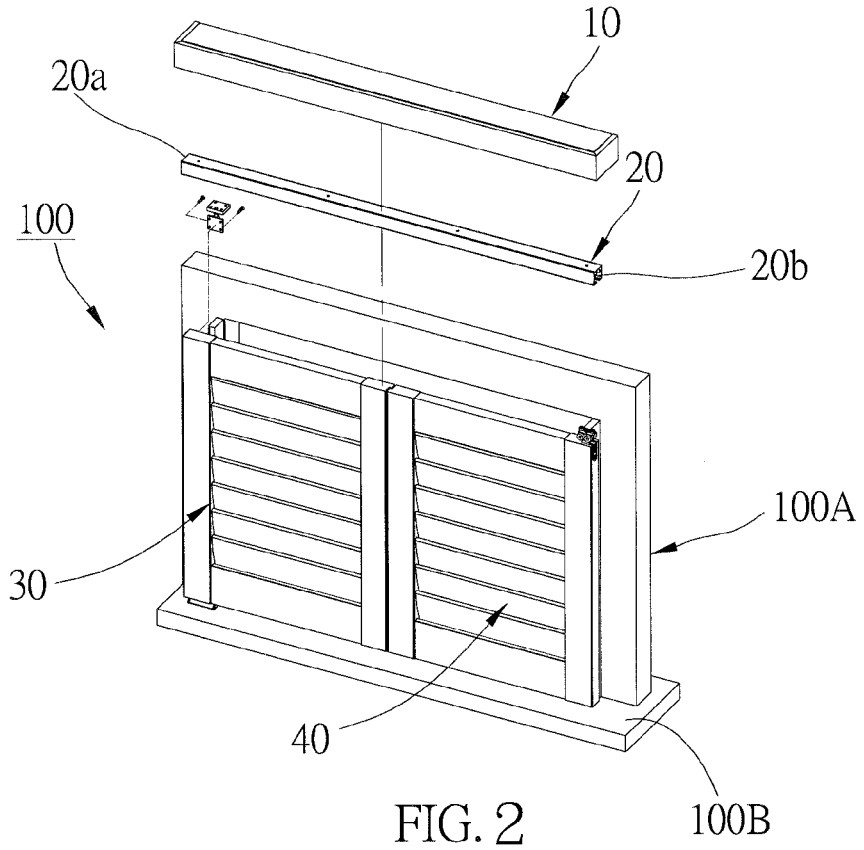
FIG. 2 is an exploded view of a first preferred embodiment of the present invention, showing the first and the second sashes in the extended condition.

The detailed description and technical contents of the present invention will be explained with reference to the accompanying drawings. However, the drawings are illustrative only but not used to limit the present invention.

FIGS. from FIG. 2 to FIG. 5 show a covering of an opening of a building, and it is shown as a window in the figures. The covering 100 includes a rail base, a straight rail 20, a first sash 30, and a second sash 40.

We take a case 10 for example to describe the rail base of the covering 100. The case 10 is a hollow rectangular bar with a bottom opening at a bottom thereof. The case 10 is mounted on a window frame 100A, or it may be mounted on a sidewall the opening of the building directly. The case 10 has a front side 12 at a front and a rear side 14 at a rear (FIG. 6), which are vertical planes and parallel to an elongated axis of the case 10. A distance between the front side 12 and the rear side 14 (so called a width of the case 10) is defined as a first distance L1. The rail 20 is received in the case 10 and fixed therein, therefore the rail 20 is fixed to the window frame 100A (or the wall) through the case 10. The case 10 provides a space between the wall and the sashes 30, 40 for the sashes 30, 40 to turn and move.

The rail 20 is exposed via the bottom opening of the case 10. The rail 20 is an elongated hollow member with a rail opening 26 at a bottom thereof. The rail 20 has a first end 20*a* and a second end 20*b* at opposite ends, and the rail 20 is straight from the first end 20*a* to the second end 20*b*. The rail 20 further has a front side 22 and a rear side 24, which are vertical planes and parallel to an elongated axis of the rail 20. A distance between the front side 22 and the rear side 24 (so called a width of the rail 20) is defined as a second distance L2, and the second distance L2 is shorter than the first distance L1. The rail 20 is closer to the front side 12 of the case 10 than the rear side 14, so that a space S is left between the rear side 24 of the rail 20 and the rear side 14 of the case 10.

The first and the second sashes 20, 40 are hinged with each other by two hinges 50, so that they may be moved between an extended condition and a folded condition. A pivoting base 32 is fixed to a rear side 30*a* of the first sash 30 and adjacent to a top of the first sash 30. The pivoting base 32 has a vertical bore 32*a*. A first axle 34 has an end fixed to a bottom of a fixed board 28. The fixed board 28 has a plurality of openings 28*a* for bolts (not shown) to fix the fixed board 28 to an interior side of a top of the case 10, therefore the fixed board 28 and the first axle 34 are received in the space S of the case 10. The fixed board 28 is closer to the first end 20*a* of the rail 20 than the second end 20*b*. The first axle 34 is inserted into the bore 32*a* of the pivoting base 32, so that the pivoting base 32 is under in the space S, and the first sash 30 is under the rail 20. The first axle 34 is a center of rotation of the first sash 30. In an embodiment, the fixed board 28 is fixed to the rear side 24 of the rail 20 rather than the case 10. In another embodiment, the first axle 34 is pivoted on the rear side 24 of the rail 20 without the pivoting base 32.

The second sash 40 is provided with a pulley assembly 42 at a top 40*a* thereof. The pulley assembly 42 includes a base member 42*a* and pulleys 42*b* connected to the base member 42*a* for free rotation. The base member 42*a* is received in the rail 20, and the pulleys 42*b* engage the rail 20 to let the pulley assembly 42 reciprocates along the rail 20. A second axle 44 has an end fixed to the base member 42*a* of the pulley assembly 42 and the other end connected to the top 40*a* of the second sash 40 to pivot the pulley assembly 42 on the top 40*a* of the second sash 40. The second axle 44 moves along the rail 20 between the first end 20*a* and the second end 20*b*.

Figure 6:
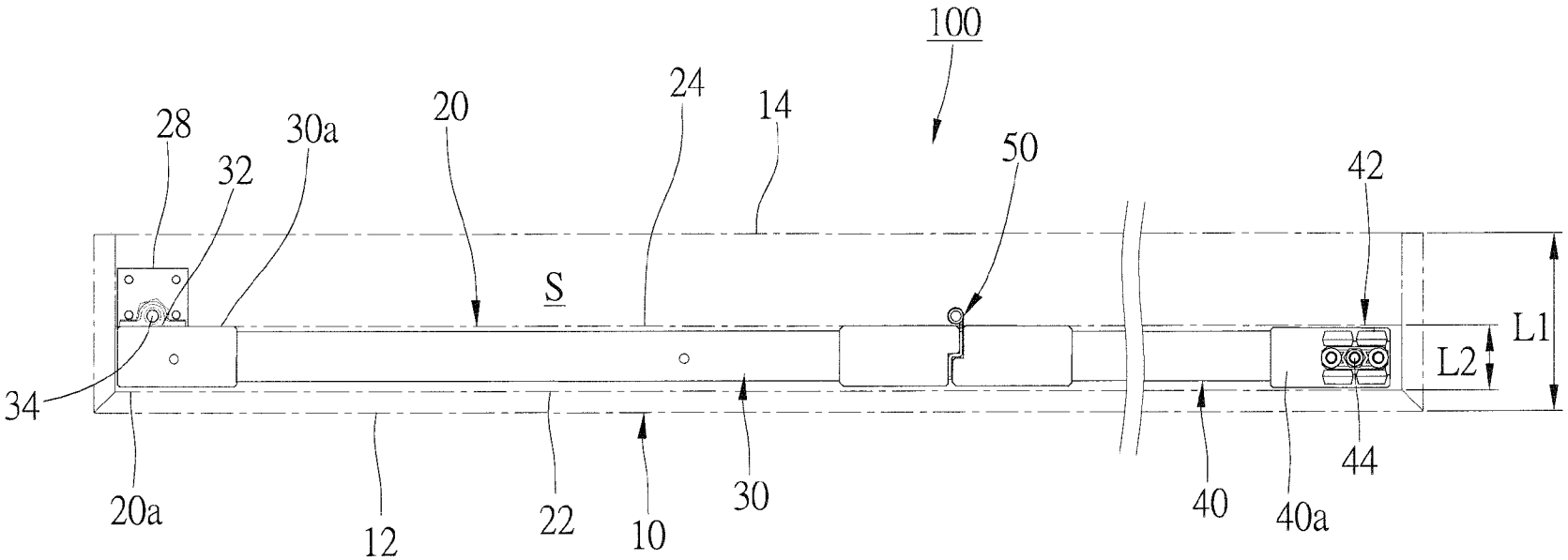
FIG. 6 is a top view of the first preferred embodiment of the present invention, showing the first and the second sashes in the extended condition.

FIG. 6 shows the first and the second sashes 30, 40 in the extended condition in which the second sash 40 is moved to the second end 20*b* of the rail, and both the sashes 30, 40 close the opening. In the extended condition the first axle 34 is adjacent to the first end 20*a* of the rail 20, and the second axle 44 is adjacent to the second end 20*b*. Furthermore, the first axle 34 is under the space S (behind the rear side 24 of the rail 20), and the second axle 44 is under the rail 20. In other words, the first axle 34 is not on a moving path of the second axle 44.

Figure 7:
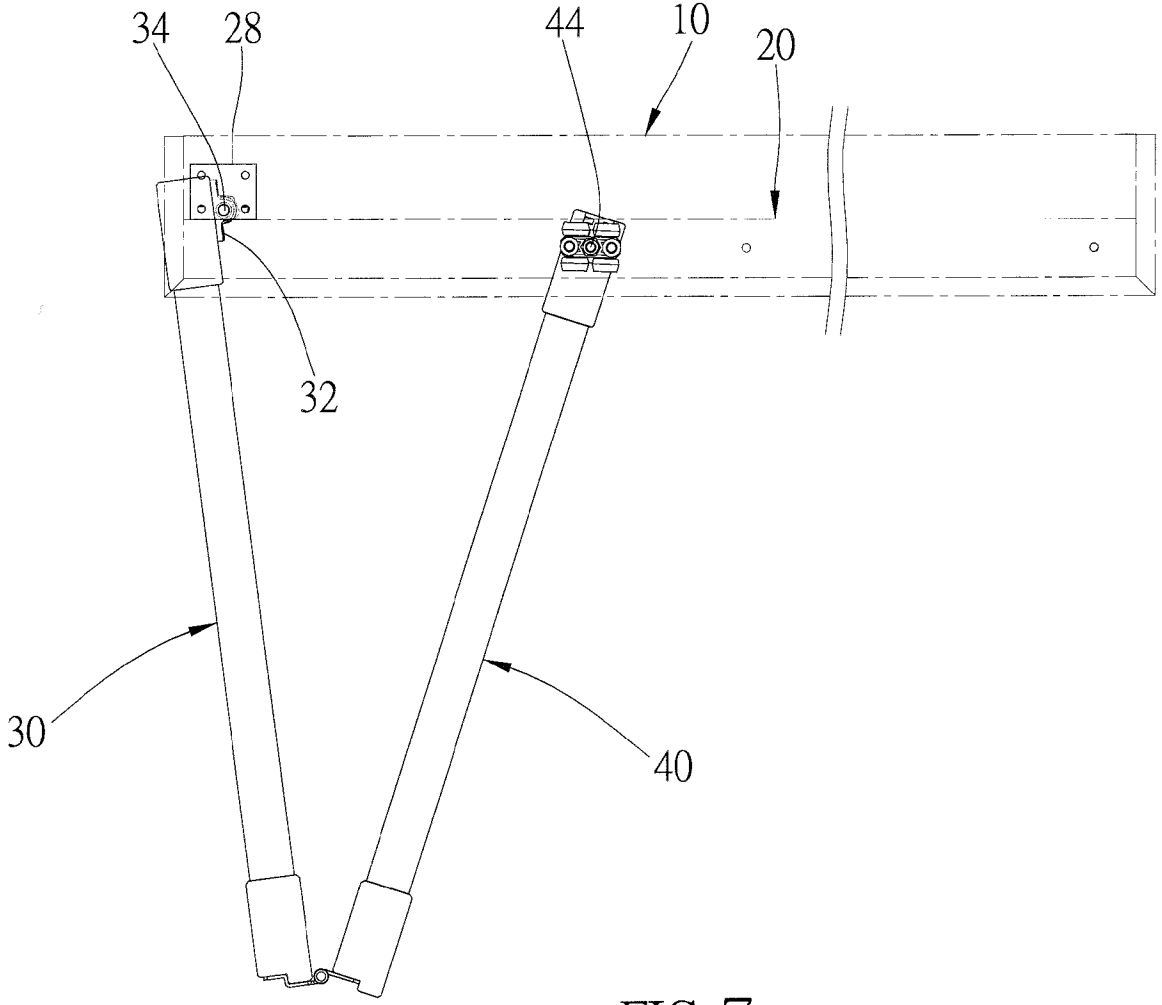
FIG. 7 is a top view of the first preferred embodiment of the present invention, showing the second sash moved toward the first sash.
Figure 8:
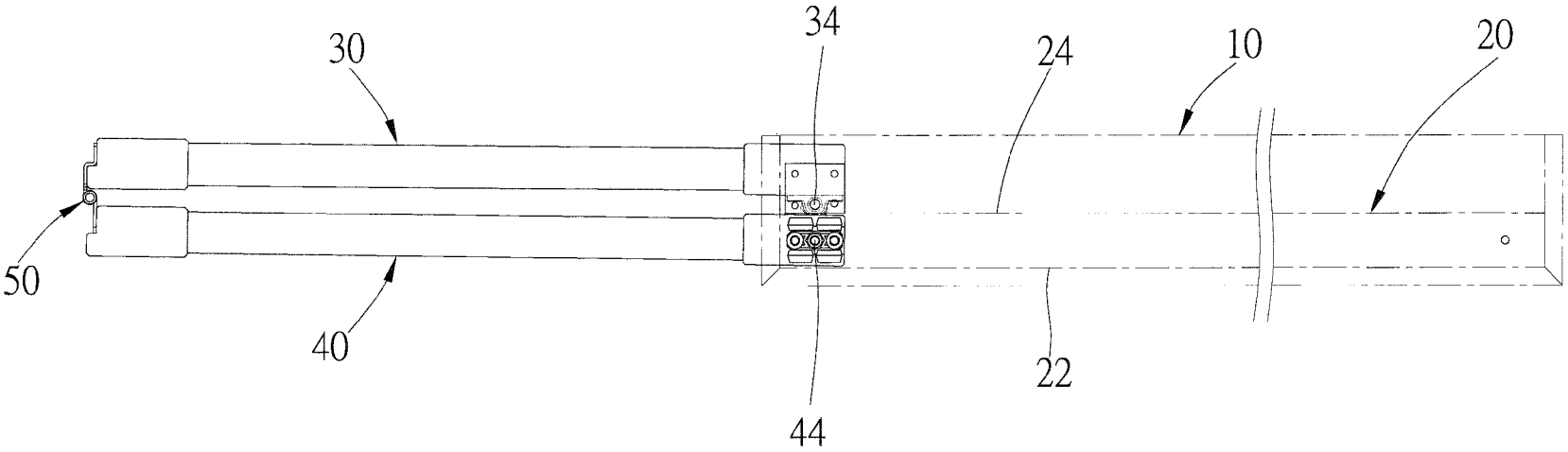
FIG. 8 is a top view of the first preferred embodiment of the present invention, showing the first and the second sashes folded and attached to the wall.

FIG. 7 shows the second sash 40 being moved toward the first end 20*a* of the rail 20. During the movement, the second sash 40 moves and turns, and the first sash 30 turns, and then the first sash 30 and the second sash 40 will be folded. Keep moving the folded sashes 30, 40 will turn them for 180 degrees and attach them to a wall by the opening. During this movement, the first sash 30 and the second sash 40 will be kept in a folded condition.

The entire rail 20 used in the covering 100 is straight, so that the present invention would not have the drawbacks of the prior arts. When the covering 100 is opened, the sashes 30, 40 are folded and attached to the wall by the opening that may reduce the space for the covering 100.

Figure 3:
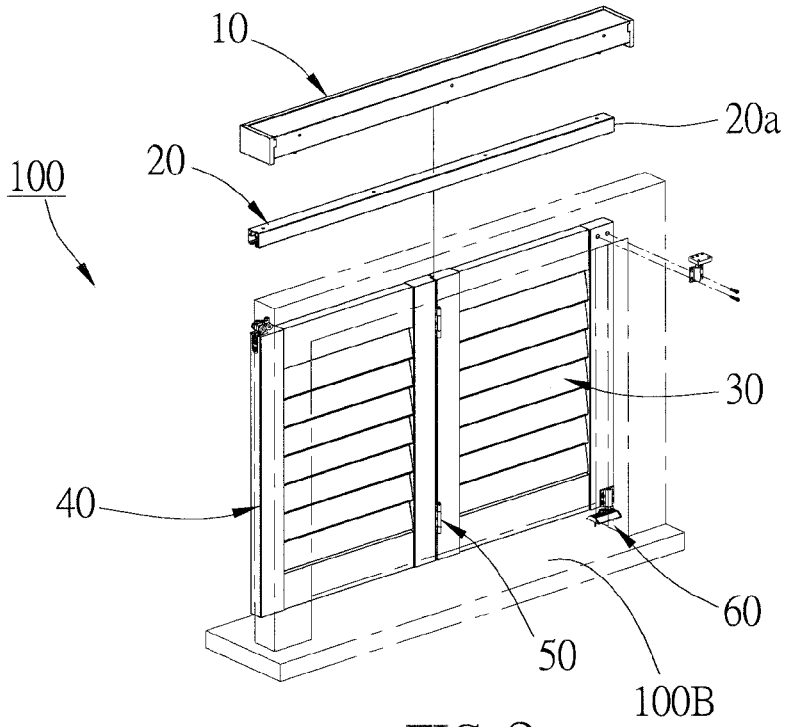
FIG. 3 is another exploded view of the first preferred embodiment of the present invention.
Figure 4:
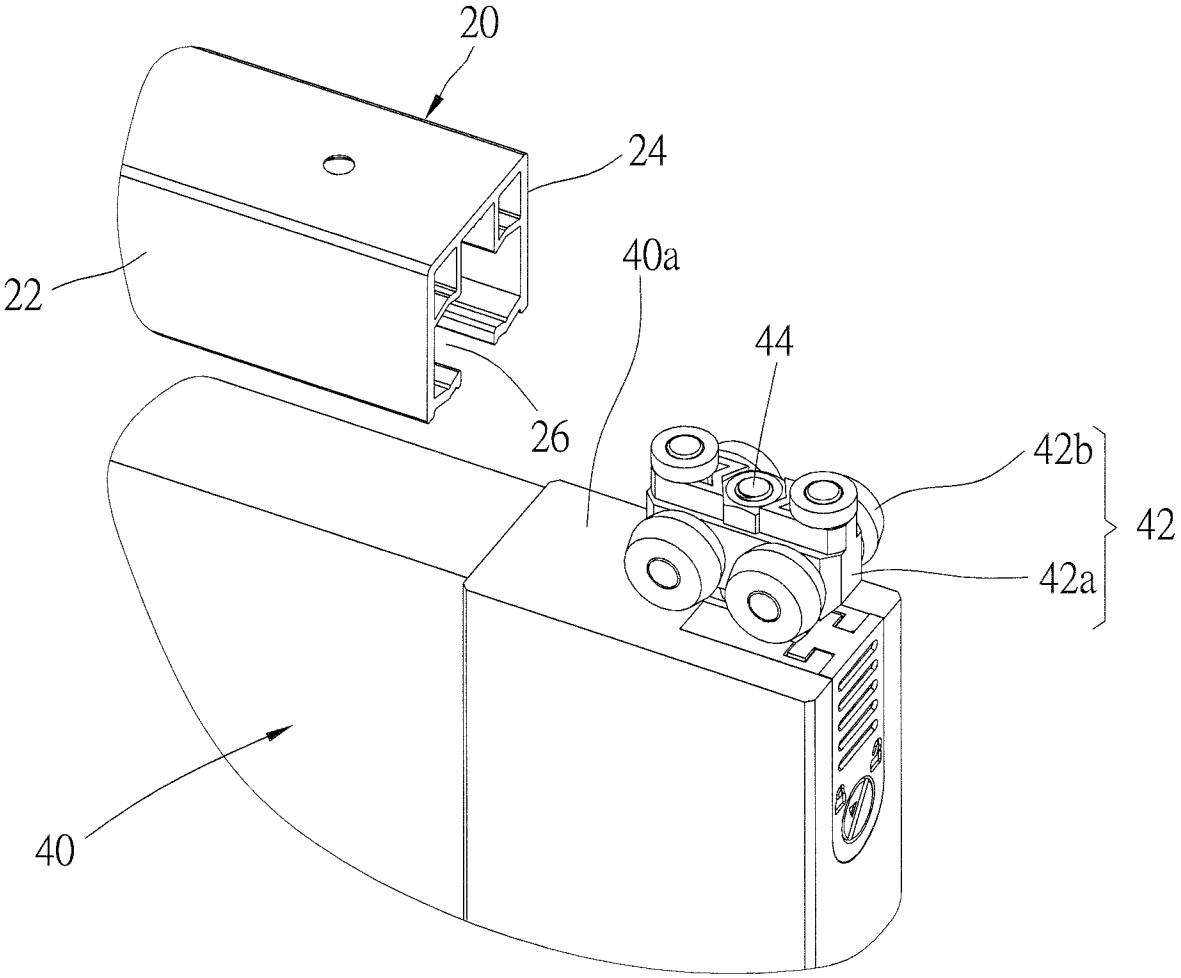
FIG. 4 is a perspective view of the first preferred embodiment of the present invention, showing the pulley and the rail in the extended condition.
Figure 5:
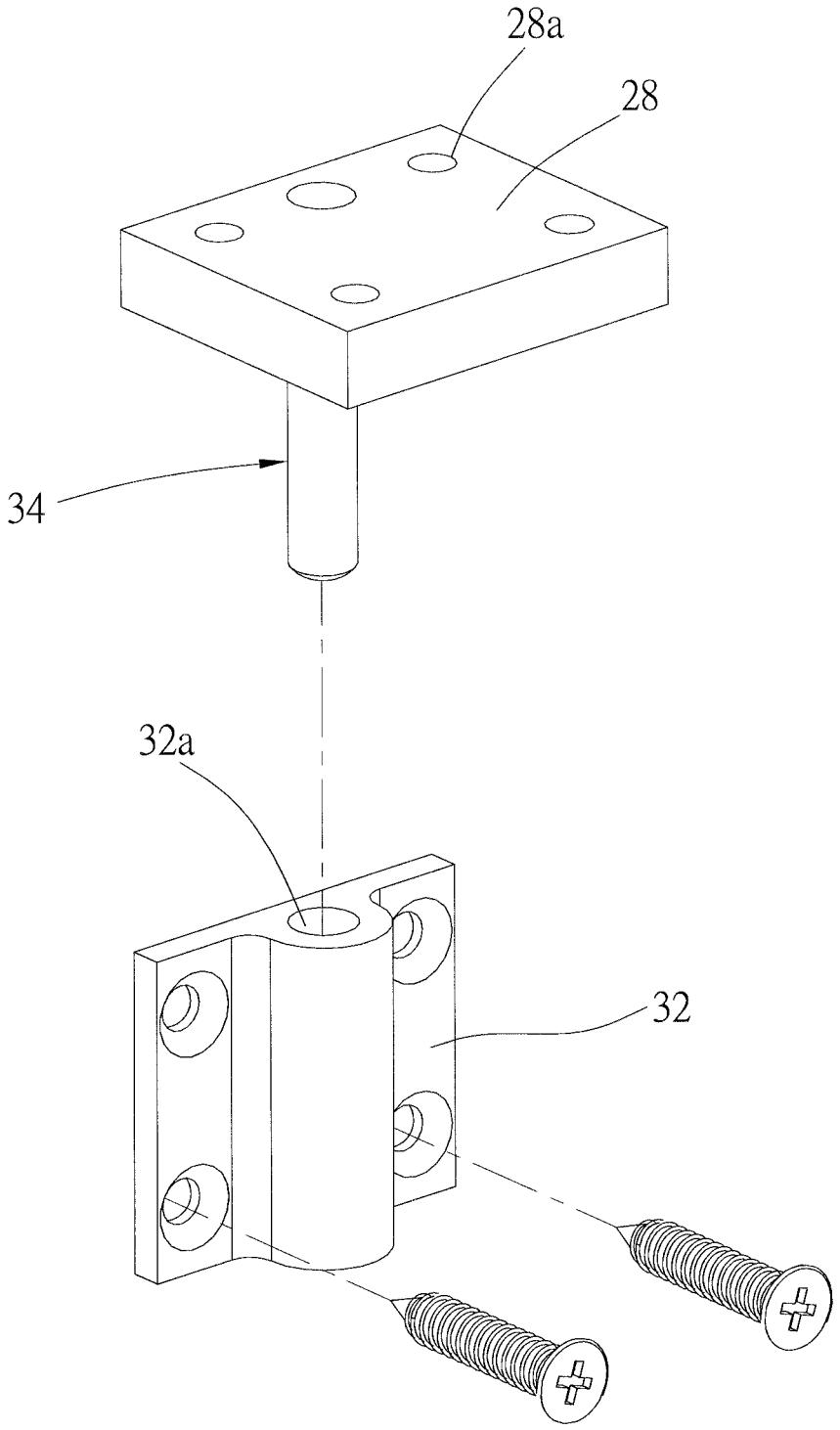
FIG. 5 is an exploded view of the first preferred embodiment of the present invention, showing the fixed board, the first axle, and the pivoting base.
Figure 9:
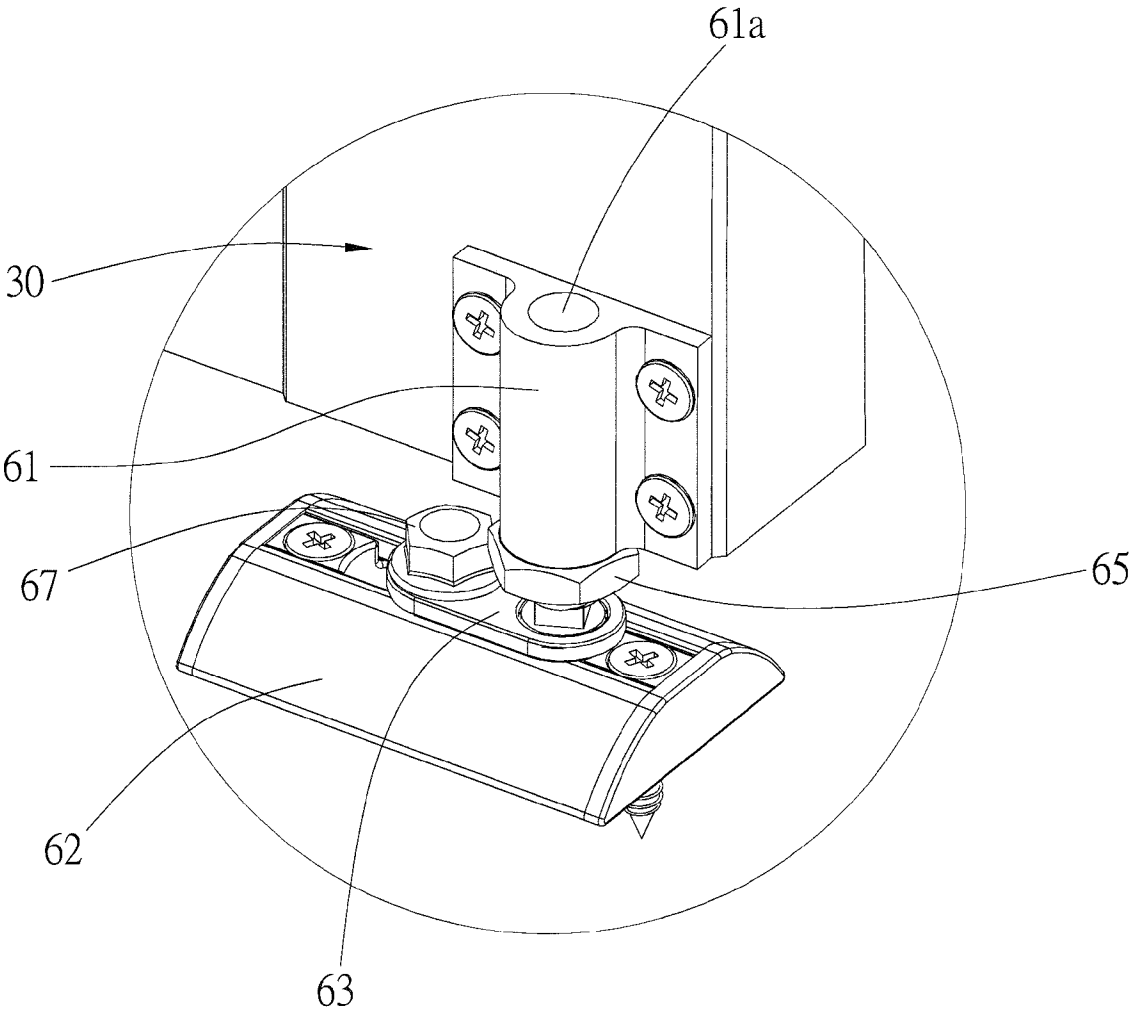
FIG. 9 is a perspective view of the adjustable assembly of the first preferred embodiment of the present invention.
Figure 10:
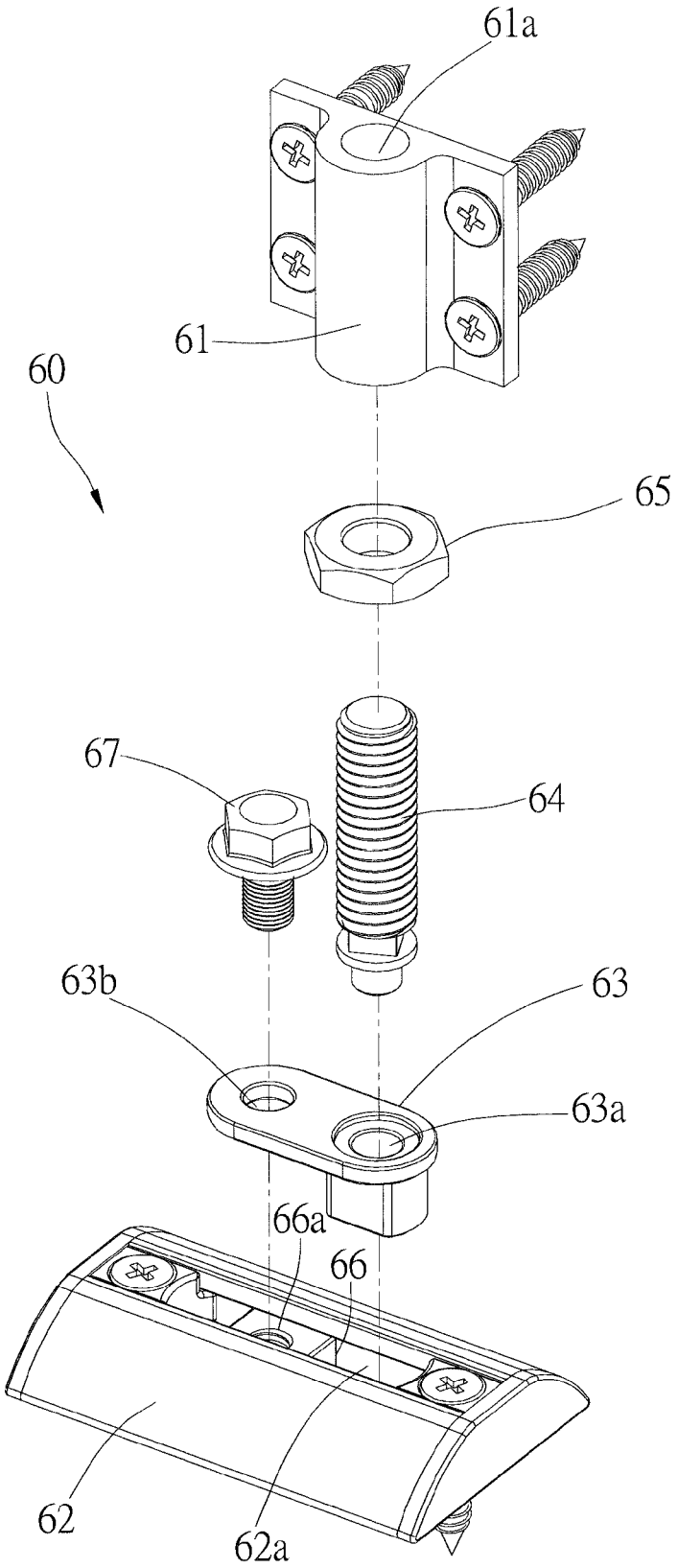
FIG. 10 is an exploded view of the adjustable assembly of the first preferred embodiment of the present invention.

As shown in FIGS. 3, 9, and 10, an adjustable assembly 60 is provided under the first sash 30. The adjustable assembly 60 includes a lateral member 61, a base member 62, a movable plate 63, a threaded rod 64, a nut 65, movable block 66, and a bolt 67. The lateral member 61 is fixed to a lateral side of the first sash 30, and has an axial bore 61*a*. The base member 62 is fixed to a bottom board 100B of the window frame 100A, and has an elongated slot 62*a*. The movable plate 63 engages the slot 62*a* of the base member 62 to move along the slot 62*a*. The movable plate 63 has an opening 63*a* and a through hole 63*b*. An end of the threaded rod 64 is screwed into the nut 65, and then is screwed into the axial bore 61*a* (the axial bore 61*a* is threaded) to rest the nut 65 on a bottom of the lateral member 61. The other end of the threaded rod 64 is inserted into the opening 63*a* of the movable plate 63. The opening 63*a* has a cavity at a top and a hole at a bottom of the cavity, and the thread rod 64 has a rim at the end and a protrusion on the rim. The protrusion is received in the hole, and the rim is received in the cavity, so that the threaded rod 64 is able to turn freely related to the base member 62.

Therefore, a vertical position of the first sash 30 is adjustable by turning the nut 65 and the threaded rod 64 respectively. The adjustment of the vertical position of the first sash 30 could even the first sash 30 and the second sash 40 to make the movement of the sashes 30, 40 smoothly.

While the adjustable assembly only provides user to adjust the vertical position of the sash, it may provide opening 63*a* on the base member directly. In other words, the adjustable assembly adjusts the vertical position of the sash without the movable plate 63.

The movable block 66 is movably received in the slot 62*a*, and has a threaded hole 66*a*. The bolt 67 passes through the through hole 63*b* of the movable plate 63, and is screwed into the threaded hole 66*a* of the movable block 66. The movable block 66 will be secured in the slot 62*a* by tightening the bolt 67. In other words, the position of the threaded rod 64 along the slot 62*a* is adjustable by moving the movable block 66 to a desired position, and then tightening the bolt 67. As a result, a horizontal position of the first sash 30 is adjustable, which may make the movement of the sashes 30, 40 smoothly. At the same time, the first axle 34 is fixed to the fixed board 28 on the bottom of the case 10, and the openings 28*a* on the fixed board 28 could be elongated, which facilitates the movable plate 63 to move in the slot 62*a*.

Figure 11:
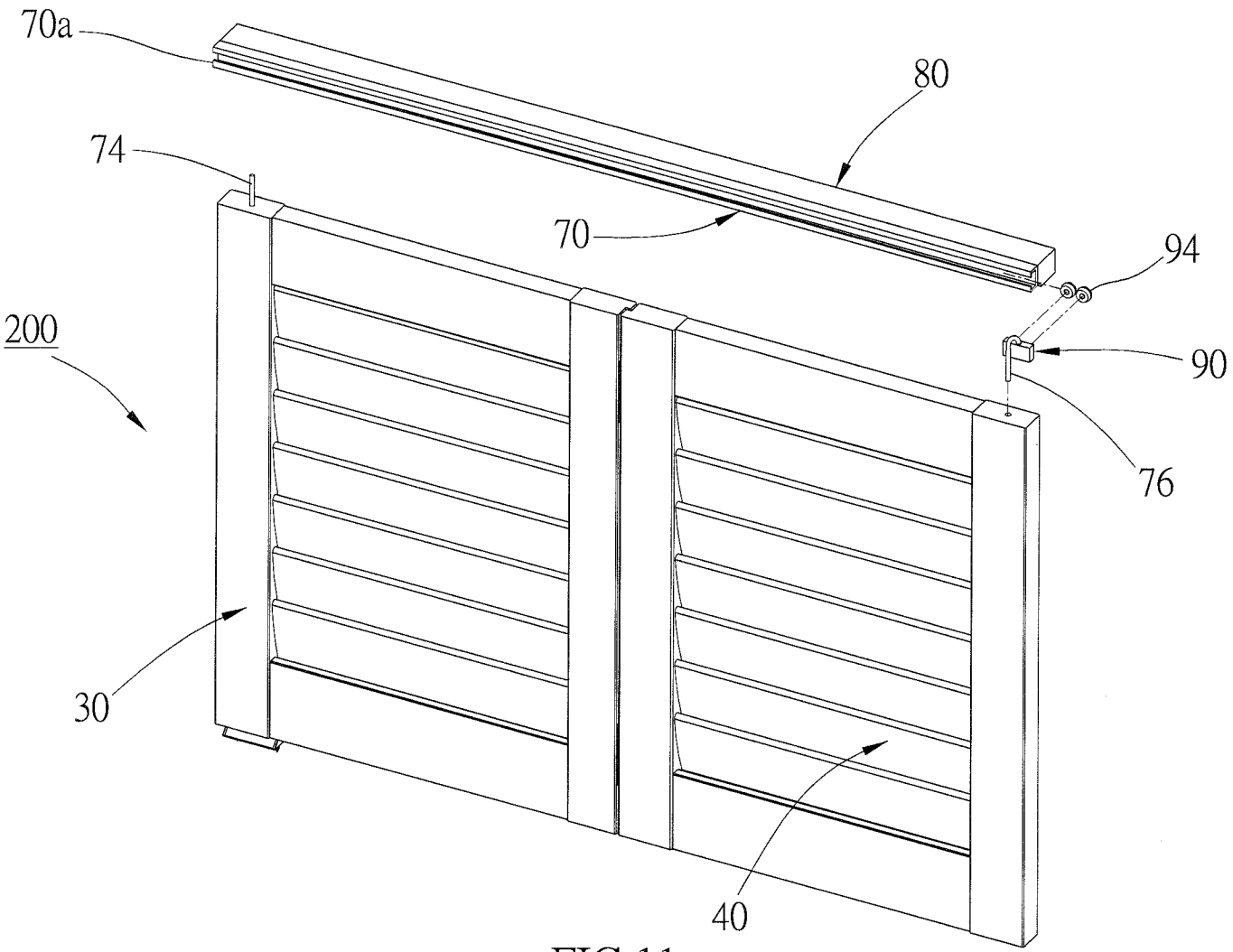
FIG. 11 is an exploded view of a second preferred embodiment of the present invention.
Figure 12:
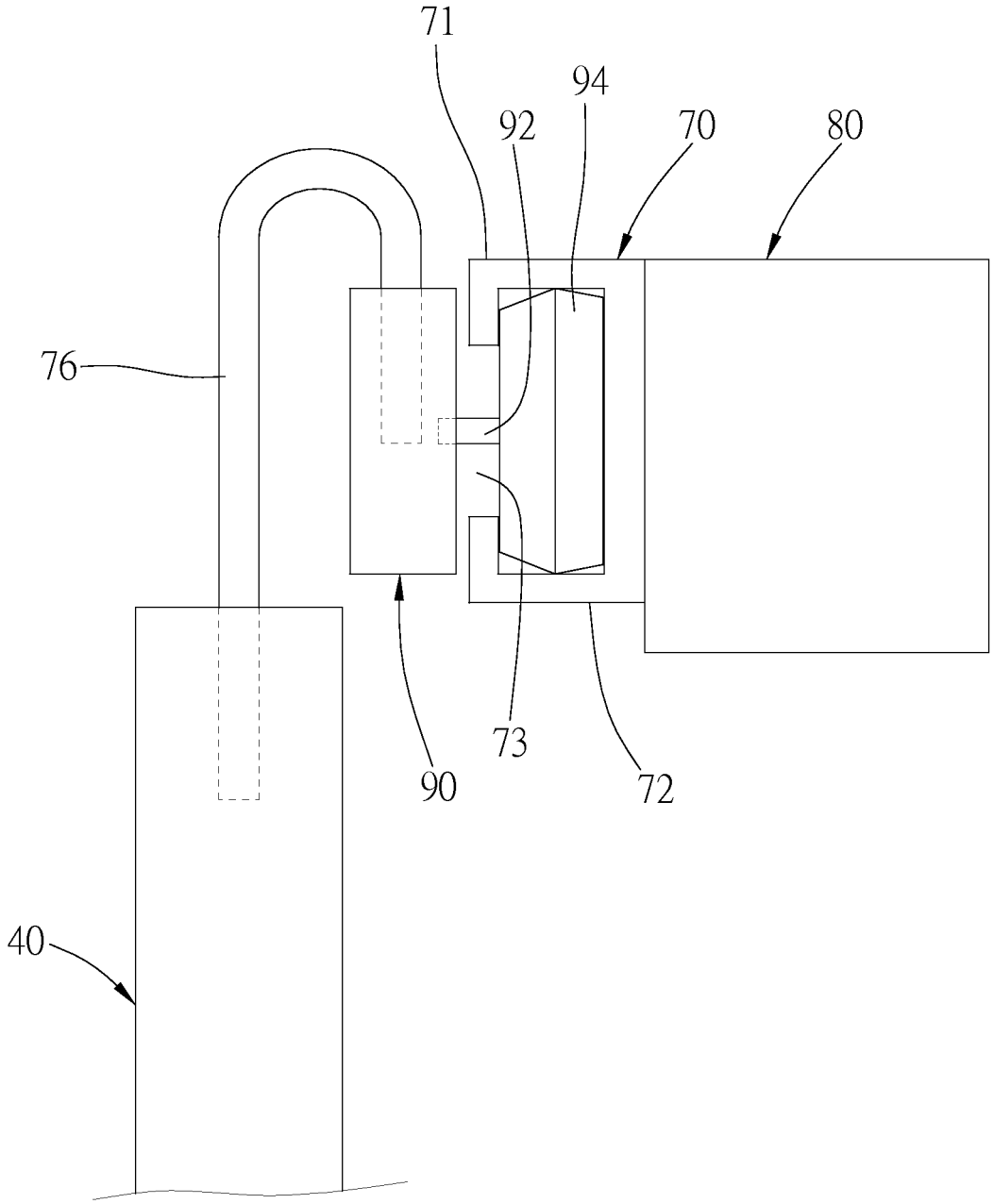
FIG. 12 is a sketch diagram of the second preferred embodiment of the present invention, showing the first and the second sashes and the rail.

FIG. 11 and FIG. 12 show a covering 200 of the second preferred embodiment of the present invention, which is basically the same to the first preferred embodiment, except that a rail 70 is fixed to a front side of a beam 80 instead of the case 10. The case 10, the beam 80, and their equivalent devices could be called rail base. The rail 70 has a top side 71 and a bottom side 72, and has an elongated rail opening 73 at a front thereof, which is between and parallel to the top side 71 and the bottom side 72. A first axle 74 is connected to a top of the first sash 30, and a second axle 76 is connected to the second sash 40. The first axle 74 is adjacent to a first end 70*a* of the rail 70 and under the bottom side 72 of the rail 70. The second axle 76 has an end inserted into a pulley base 90 for free rotation. Two pulleys 94 are connected to the pulley base 90 through two axles 92. The pulleys 94 are received in the rail 70 to move along the rail 70, and the pulley base 90 is left out of the rail 70 via the rail opening 73. The second axle 76 is a U-shaped (hook-shaped?) bar having opposite ends inserted into bores on the tops of the second sash 40 and the pulley base 90. The second axle 76 is fixedly connected to the second sash 40, and pivotally connected to the pulley base 90. As a result, the second sash 40 is able to turn and reciprocate along the rail 70.

The movement and function of the first and the second sashes 30, 40 are the same as the first preferred embodiment. The same as above, the first axle 74 is not on a moving path of the second axle 76, so that the sashes 30, 40 may be totally moved off the opening and attached to the wall by the opening.

The description above is only a few preferred embodiments of the present invention and the equivalence of the present invention is still in the scope of claim construction of the present invention.

What is claimed is:

1. A covering of a building opening, comprising:

a rail having a first end and a second end at opposite ends, wherein the rail is straight from the first end to the second end;

a first sash connected to a first axle, wherein the first axle is adjacent to the first end of the rail;

a second sash hinged with the first sash, and connected to a second axle, wherein the second axle is engaged with the rail to reciprocate along the rail;

wherein the first axle is not on a moving path of the second axle, nor an extending line of the moving path of the second axle;

wherein the rail has a front side at a front and a rear side at a rear;

wherein the rail is in front of the first axle;

wherein the first sash and the second sash can be folded together by moving the second axle in the rail, and the folded first and second sashes are rotatable toward the front side of the rail;

wherein when the first sash and the second sash are folded together, the first sash crosses the rail; and wherein when the first sash and the second sash are together rotated to be parallel to an extension direction of the rail, the second sash is just in the extension direction of the rail.

2. The covering as defined in claim 1, wherein the rail has a rail opening at a bottom; the first axle is by the rear side of the rail and near the first end; the second axle has opposite ends engaged with the rail via the rail opening and connected to the second sash respectively.

3. The covering as defined in claim 2, further comprising a wheel assembly engaged with the rail to reciprocate along the rail, wherein the opposite ends of the second axle are connected to the wheel assembly and a top of the second sash respectively.

4. The covering as defined in claim 2, further comprising a rail base and a pivoting base, wherein the rail is fixed to a bottom of the rail base, and the pivoting base is fixed to the rear of the first sash; the first axle is vertical which has an end connected to the rail base and an opposite end pivoted on the pivoting base.

5. The covering as defined in claim 4, wherein the rail base comprises a case, and the case has a front side and a rear side; the rail is received in the rail base between the front side and the rear side; a distance between the front side and the rear side of the rail base is greater than a distance between the front side and the rear side of the rail.

6. The covering as defined in claim 1, wherein the rail has a top side at a top, a bottom side at a bottom, and a rail opening at a front; the first axle is under the bottom side of the rail and near the first end; the second axle has opposite ends engaged with the rail via the rail opening and connected to the second sash respectively.

7. The covering as defined in claim 6, further comprising a wheel base and a wheel connected to the wheel base for rotation, wherein the wheel is engaged with the rail, and the wheel base is left out of the rail; the opposite ends of the second axle are connected to the wheel base and the second sash respectively.

8. The covering as defined in claim 7, wherein the second axle is a U-shaped bar having the opposite ends connected to a top of the wheel base and a top the second sash respectively.

9. The covering as defined in claim 1, further comprising an adjustable assembly under the first sash for changing a vertical position of the first sash.

10. The covering as defined in claim 9, wherein the adjustable assembly includes a lateral member, a base member, and a thread rod; the lateral member is fixed to the first sash and has a threaded axial bore; the thread rod has an end screwed into the axial bore of the lateral member and an opposite end connected to the base member, whereby the vertical position of the first sash is changed by turning the thread rod.

11. The covering as defined in claim 10, wherein the base member has a cavity and a hole at a bottom of the cavity, and the thread rod has a rim and a protrusion on the rim; the protrusion is received in the hole, and the rim is received in the cavity, whereby the threaded rod turns freely related to the base member.

12. The covering as defined in claim 1, further comprising an adjustable assembly under the first sash for change a horizontal position of the first sash.

13. The covering as defined in claim 12, wherein the adjustable assembly includes a lateral member, a base member, a rod, and a movable plate; the lateral member is fixed to the first sash; the base member has an elongated slot, and the movable plate is engaged with the slot to move along the slot; the rod has opposite end connected to the movable plate and the lateral member, whereby the horizontal position of the first sash is adjusted by moving the movable plate.

14. The covering as defined in claim 13, wherein the adjustable assembly further includes a movable block received in the slot of the base member and a bolt; the movable block has a threaded hole, and the movable plate has a through hole; the bolt passes through the through hole of the movable plate, and is screwed into the threaded hole of the movable block to fix the movable plate to the base member by tightening the bolt.

* * * * *